US007501773B2

(12) United States Patent
Tipton

(10) Patent No.: US 7,501,773 B2
(45) Date of Patent: Mar. 10, 2009

(54) MULTISTRIKE GAS DISCHARGE LAMP IGNITION APPARATUS AND METHOD

(75) Inventor: Frederick James Tipton, Acton, MA (US)

(73) Assignee: Xenon Corporation, Wilmington, DE (US)

( * ) Notice: Subject to any disclaimer, the term of this patent is extended or adjusted under 35 U.S.C. 154(b) by 293 days.

(21) Appl. No.: 11/408,849

(22) Filed: Apr. 21, 2006

(65) Prior Publication Data

US 2007/0247080 A1 Oct. 25, 2007

(51) Int. Cl.
*H05B 37/00* (2006.01)

(52) U.S. Cl. ..... 315/246; 315/224; 315/DIG. 5

(58) Field of Classification Search ..... 315/DIG. 5, 315/DIG. 7, 224, 246, 291
See application file for complete search history.

(56) References Cited

U.S. PATENT DOCUMENTS

| | | | | |
|---|---|---|---|---|
| 4,167,669 | A | 9/1979 | Panico | |
| 4,949,017 | A | 8/1990 | Sikora | |
| 4,956,584 | A | 9/1990 | Sikora | |
| 7,091,495 | B2 | 8/2006 | Panico et al. | |
| 7,098,605 | B2 * | 8/2006 | Oh | 315/291 |
| 7,150,806 | B2 | 12/2006 | Panico et al. | |
| 2002/0166043 | A1 | 11/2002 | Panico | |
| 2002/0186014 | A1 | 12/2002 | Panico et al. | |
| 2003/0044311 | A1 | 3/2003 | Sousa et al. | |
| 2004/0028553 | A1 | 2/2004 | Panico | |
| 2004/0100209 | A1 | 5/2004 | Abe | |
| 2004/0183455 | A1 * | 9/2004 | Schallmoser | 315/120 |
| 2005/0252866 | A1 | 11/2005 | Beckinghausen | |
| 2007/0095480 | A1 | 5/2007 | Panico et al. | |
| 2008/0001321 | A1 | 1/2008 | Panico et al. | |
| 2008/0150443 | A1 | 6/2008 | Tipton | |

FOREIGN PATENT DOCUMENTS

| | | | |
|---|---|---|---|
| EP | 0 337 021 | A1 | 10/1989 |

OTHER PUBLICATIONS

International Search Report and Written Opinion, International Patent Application No. PCT/US2007/009176, Xenon Corporation, Aug. 27, 2008, 8 pages.

* cited by examiner

*Primary Examiner*—David Hung Vu
(74) *Attorney, Agent, or Firm*—Wilmer Cutler Pickering Hale and Dorr LLP

(57) ABSTRACT

A gas discharge lamp has a gas and has a cathode, an anode, and an ignition electrode. Individual discharges of a series of lamp discharges are spaced at least one millisecond from each other, and the individual discharges are generated by providing an electrical charge between the cathode and the anode and providing two or more electrical pulses to the ignition electrode. The second and following electrical pulses occur within a predetermined time of the first pulse. The electrical charge between the cathode and anode is of sufficient voltage and current to create an electrical arc between the cathode and the anode with the gas is ionized.

18 Claims, 3 Drawing Sheets

MULTISTRIKE GAS DISCHARGE LAMP IGNITION APPARATUS AND METHOD

BACKGROUND OF THE INVENTION

The present invention generally relates to ignition of gas discharge lamps, such as a xenon flash lamp.

Gas discharge lamps may be used in a variety of applications, including spectroscopic analysis, photography, and biological sterilization. Because the emissions spectra of some gas discharge lamps, for example a xenon flash lamp, includes ultraviolet (UV) wavelengths, these lamps may be used for decontamination. Likewise, the UV light emitted by such lamps may be used for UV flash curing or flash sanitization, decontamination, and sterilization.

Gas discharge lamps contain a rare gas, such as xenon or krypton, in a transparent bulb. The gas may be at pressures above or below atmospheric pressure. The lamps have a cathode and an anode through which an electrical current is provided to create an electrical arc. In order for the gas to conduct the electrical energy between the electrodes, the gas is ionized to reduce its electrical resistance. Once the gas is ionized, electrical energy conducts through the gas and excites the molecules of the gas. When the molecules return to their unexcited energy state, they release light energy.

Some types of gas discharge lamps may be operated in a pulsed fashion such that a train of light pulses is emitted from the lamp rather than a continuous light emission. In this type of lamp, the electrical current provided across the cathode and anode is released in short bursts, rather than supplied in a continuous manner. This results in a single discharge or "flash" of light.

Typically, in order to ionize the gas, a high voltage pulse is applied to an ignition electrode on the outside of the bulb, such as a wire mesh wrapped around the outside of the bulb. When a voltage is applied to the wire mesh, the gas inside the bulb is ionized, and the gas may then conduct electricity through the main electrodes. This ionization may also be achieved by an injection triggering method, which applies a voltage directly into a lamp through one or more of the lamp electrodes.

SUMMARY

The high voltage pulse supplied to the ignition electrode does not always ionize the gas enough to allow the gas to conduct electricity. This may be due to a variety of reasons. For example, the main electrodes may be dirty or old, the cathode may not be emitting electrons at the proper rate, or the gas pressure inside the lamp may be high. When the gas fails to ionize properly, the lamp does not discharge.

Embodiments are disclosed for apparatus and methods for increasing the reliability of the discharge response in gas discharge lamps. In one embodiment, multiple ignition pulses are generated to trigger a single lamp discharge. The multiple ignition pulses, in rapid succession, are believed to improve the ionization of the gas, resulting in an improvement in lamp discharge reliability.

One embodiment includes a method of producing a series of light discharges from a gas discharge lamp. The gas discharge lamp contains a gas and has a cathode, an anode, and an ignition electrode. Individual discharges of the series are spaced at least one millisecond from each other. Each individual discharge is generated by providing two electrical pulses to the ignition electrode. The second of the two electrical pulses occurs within a short time from the first pulse. The electrical charge between the cathode and anode is of sufficient voltage and current to create an electrical arc between the cathode and the anode.

Another embodiment includes an apparatus having a gas discharge lamp, a pulse generating system and a power supply. The gas discharge lamp has a cathode, an anode, and an ignition electrode. The pulse generating system provides a first electrical pulse and a second electrical pulse to the ignition electrode. The second pulse occurs soon after the first pulse. The power supply generates one discharge between the cathode and anode per set of first and second electrical pulses.

A further embodiment includes an apparatus having a gas discharge lamp, a pulse generating system and a power supply. The gas discharge lamp has a cathode, an anode, and an ignition electrode. The pulse generating system provides a first electrical pulse and a second electrical pulse to the ignition electrode. The second pulse occurs within a predetermined time after the first pulse. The power supply generates a continuous discharge between the cathode and anode initiated by the set of first and second electrical pulses.

In various embodiments, the time between the two pulses (or voltage signals) is 300 microseconds or less. In other embodiments, the time is 150 microseconds or less. In yet further embodiments, the time is 125 microseconds or less.

This triggering mechanism could be used with other methods that have been known to address issues related to reliability. For example, a radioactive gas can be provided in the lamp to decreasing the amount of ionization needed to be induced by the ignition electrode. The mechanism could be used with a feedback system to monitor whether or not the lamp has discharged in response to a trigger pulse signal. If the feedback system does not detect a lamp discharge after a trigger pulse signal has been provided, the system can initiate another ignition pulse signal.

BRIEF DESCRIPTION OF THE DRAWINGS

For a more complete understanding of various embodiments of the present invention, reference is now made to the following descriptions taken in connection with the accompanying drawings in which.

DETAILED DESCRIPTION OF THE PREFERRED EMBODIMENTS

Figure 1:
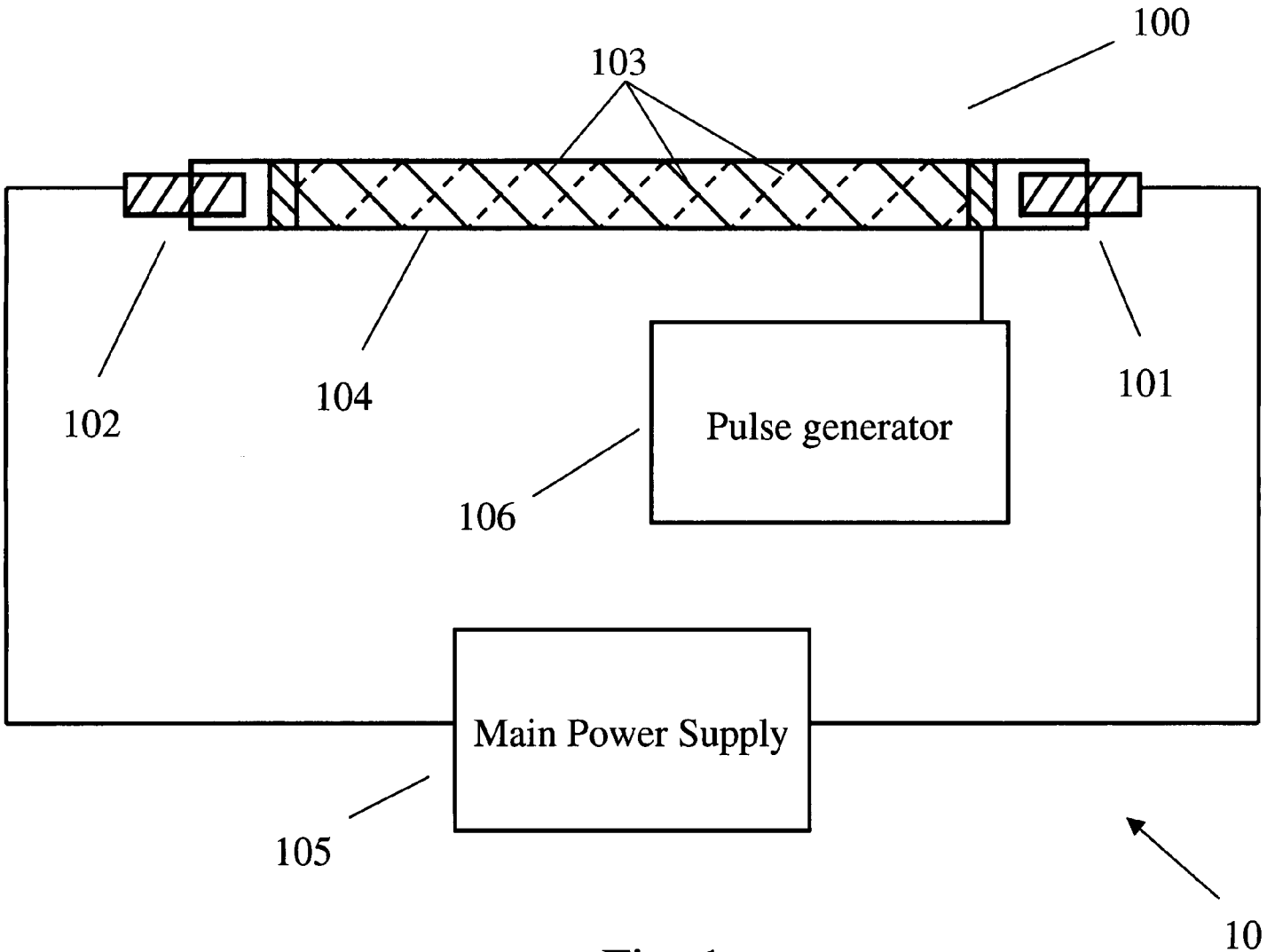
FIG. 1 is an illustration of an apparatus according to an embodiment of the invention.

FIG. 1 is an illustration of a gas discharge lamp system 10. The system 10 includes a gas discharge lamp 100, specifically, a xenon flash lamp. The lamp 100 includes a cathode 101 and an anode 102 that extend through opposite ends of a lamp tube 104. Cathode 101 and anode 102 allow an electrical connection to be made with a gas inside lamp tube 104. The lamp also includes an ignition electrode 103, which is formed by a wire encircling a portion of lamp tube 104. The wire forming ignition electrode 103 is wrapped around the outside of a portion of lamp tube 104 as it passes from one end of lamp tube 104 to the other. In other embodiments, the cathode 101 or anode 102 may serve as the ignition electrode. In yet further embodiments, the ignition electrode may be located inside the lamp.

In order to create a discharge from lamp 100, an electrical potential is applied between cathode 101 and anode 102 by, for example, a main power supply 105. This electrical potential must be high enough to create an electrical arc through the gas in lamp tube 104 once the gas is ionized. A voltage signal in the form of a single pulse in the range of 20 kV-30 kV is applied to ignition electrode 103 to ionize the gas. Upon ionization, the conductivity of the gas increases, allowing an arc to form between cathode 101 and anode 102.

For a pulsed light operation, a series of voltage signals is sent to ignition electrode 103 by, for example, a pulse generator 106. These signals may occur at a frequency of 1000 signals per second or less (i.e. a period of 1 millisecond or more). Each voltage signal is designed to create an arc and a corresponding flash of light. The voltage signal sent to ignition electrode 103 includes a second pulse, closely spaced to a first pulse, which increases the likelihood of obtaining an arc through the gas. This improves the reliability of the gas lamp discharge response. In one embodiment of the invention, the voltage signal comprises two pulses occurring within 300 microseconds of each other or less. This double pulse set corresponds to a single lamp discharge.

Figure 2:
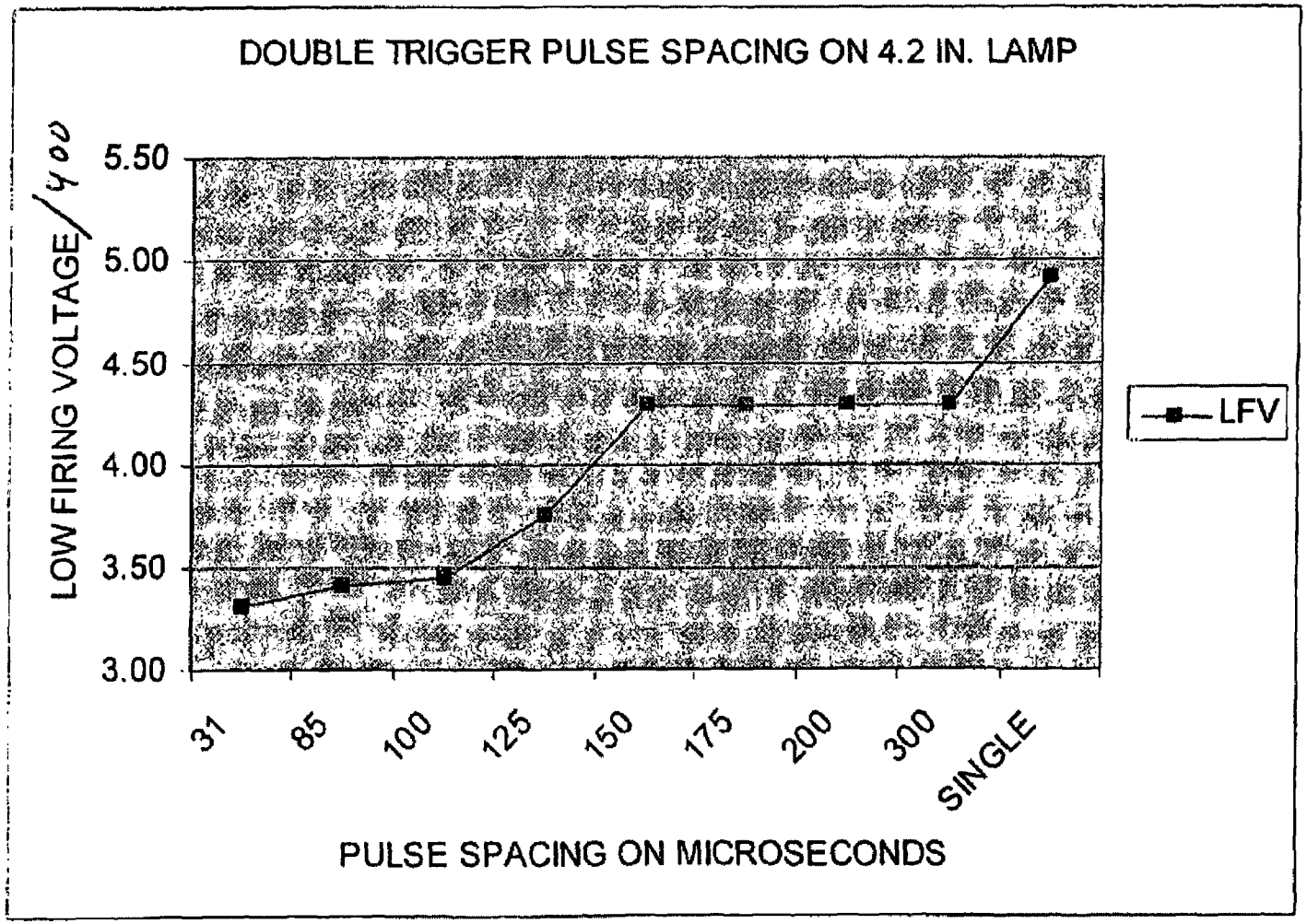
FIG. 2 is a chart showing the relationship between low firing voltage and pulse spacing obtained from testing a method practiced according to an embodiment of the invention.

FIG. 2 shows the results of a test correlating the double pulse spacing with low firing voltage. Pulse spacing is measured in microseconds and is the amount of time separating the two pulses of the double pulse set. Low firing voltage is measured in 400-volt increments (i.e. a Y-axis value of 4 represents a low firing voltage of 1600 volts). Low firing voltage may be used as a relative measure of the level of ionization present in the gas of the lamp. A small low firing voltage indicates a relatively higher level of ionization than a large low firing voltage, with all other variables remaining fixed. A lamp with a small low firing voltage will discharge more reliably than a lamp with a large low firing voltage.

As shown in FIG. 2, reduction of low firing voltage and improvement in gas ionization (resulting in higher lamp discharge reliability) occurs with a pulse spacing around 300-400 microseconds and lower. This pulse spacing allows the lamp to fire at a low firing voltage of about 88% or less of what would have otherwise been required. This test indicated that further improvement in gas ionization occurs with a pulse spacing of about 150 microseconds and lower. This pulse spacing allows the lamp to fire at a low firing voltage of about 77% or less of what would have otherwise been required. A pulse spacing of less than 125 microseconds has still further improvement. This pulse spacing allows the lamp to fire at a low firing voltage of about 70% or less of what would have otherwise been required. Although not shown in FIG. 2, additional improvement was observed by adding third and fourth pulses with similar pulse spacing.

Referring again to FIG. 1, cathode 101 and anode 102 of xenon flash lamp 100 are connected to main power supply 105. Main power supply 105 delivers voltage and current sufficient to generate an electrical arc through the gas in the lamp once the gas has been adequately ionized. For example, main power supply 105 may contain a capacitor that accumulates an electrical charge. In such an embodiment, the capacitor is connected to cathode 101 and anode 102 of lamp 100. When the gas in lamp 100 is not adequately ionized, the charge remains contained within the capacitor. When the gas in lamp 100 is adequately ionized, the electrical charge is conducted through the gas between cathode 101 and anode 102.

The gas in gas discharge lamp 100 is ionized by a voltage signal supplied by pulse generator 106 connected to ignition electrode 103. Pulse generator 106 sends a voltage signal, for example two pulses within 300 microseconds of each other or less, to ignition electrode 103. This voltage signal ionizes the gas within lamp 100, thereby enabling an arc to form through the gas in lamp 100. This arc results in a light discharge from lamp 100.

Figure 3:
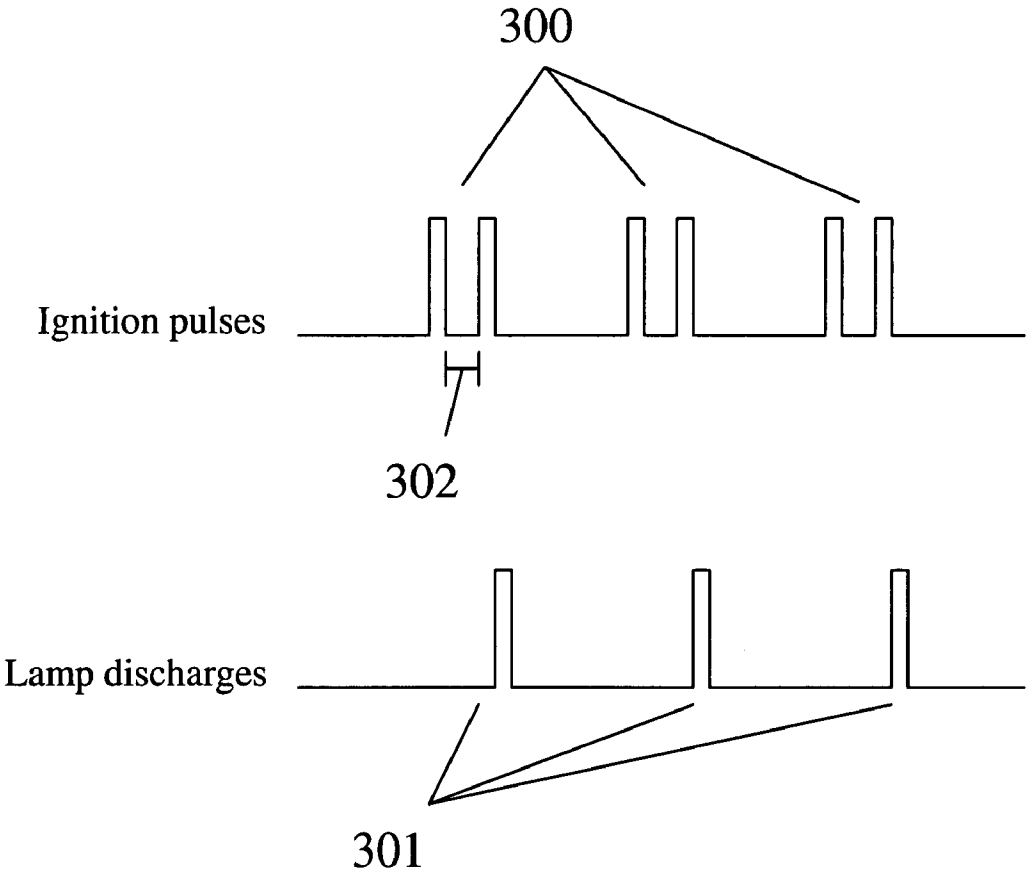
FIG. 3 is a graph of the ignition pulses and lamp discharges.

FIG. 3 illustrates the correlation between sets of ignition pulses supplied to ignition electrode 103 of FIG. 1 and light discharges from lamp 100 of FIG. 1. In one embodiment, a voltage signal has multiple sets of two ignition pulses 300. Each individual set of two ignition pulses 300 triggers a corresponding lamp discharge 301. The first and second pulses of each set occur within 300 microseconds or less of each other, as illustrated by a pulse spacing 302.

In one embodiment of pulse generator 106, there are two independent circuits that generate each of the two respective pulses of the voltage signal. For example, pulse generator 106 may have two capacitors in parallel connected to ignition electrode 103. The two capacitors are controlled (e.g. with a digital controller) to release their respective stored charges within 300 microseconds or less of each other. In other embodiments, circuitry and/or controlling components that generate the two pulses are shared. For example, pulse generator 106 may be designed to release a first pulse from a capacitor, recharge the capacitor, and release a second pulse from the capacitor within 300 microseconds or less. Embodiments may include timing circuitry for controlling the pulse separation. An inductor may also be used in place of a capacitor.

In some embodiments, the components of main power supply 105 and pulse generator 106 may be shared. For example, main power supply 105 may provide electrical power to the components of pulse generator 106.

Embodiments of the triggering circuitry may be used in a variety of gas discharge lamps, including any type of lamp requiring an ignition pulse to ionize a gas in a lamp. For example, embodiments may be used with mercury lamps, metal halide lamps, and sodium lamps. Embodiments may be used in applications involving pulsed lamp operations, in which a series of double pulses is used to ignite a series of flashes of light. Other embodiments may be used in applications involving a continuous lamp discharge, in which a set of double pulses is used to start the lamp discharge, giving the lamp a rapid-start attribute. For example, the gas in a xenon short-arc lamp may be ionized by a set of double pulses to initiate an arc between the lamp cathode and anode. Once an arc is established, the ionization is self-sustaining.

Similarly, embodiments of the triggering circuitry may be used to restart a continuous gas discharge lamp that has been operating, but has been recently been turned off. Typically, continuous gas discharge lamps suffer from a "restrike time." The restrike time is an amount of time after a continuous gas discharge lamp has been turned off during which the lamp cannot be easily restarted. This inability to restart is due, at least in part, to high gas pressure inside the lamp. Embodiments of the invention may be used to reduce the restrike time.

Furthermore, a double pulse could be used to ignite a flash lamp where the flashes are not on a periodic series, but sporadic and on-demand, as a camera flash would be. In addition, embodiments of the invention work with lamps operating across a wide variety of operating parameters, such as those listed below.

Range of Operating Parameters:

Pulse Duration: 0.1-1,000 microseconds measured at ⅓ peak energy.

Energy per Pulse: 1-2,000 joules.

Voltage Signal Recurrence Frequency: Single signal or one (1) to one thousand (1,000) signals per second.

Exposure Interval: 0.1 to 1000 seconds, or single pulse, or continuous pulsing.

Lamp Configuration (shape): Linear, helical or spiral design.

Spectral Output: 100-1,000 nanometers.

Lamp Cooling: Ambient, forced air or water.

Wavelength Selection (external to the lamp): Broadband or optical filter selective.

Lamp Housing Window: Quartz, SUPRASIL brand quartz, or sapphire for spectral transmission.

Sequencing: Burst mode, synchronized burst mode, or continuous running.

As will be realized, the embodiments and its several details can be modified in various respects, all without departing from the invention as set out in the appended claims. For example, embodiments have been described for use with xenon flash lamps and xenon short-arc lamps. Other embodiments of the invention are suitable for starting high intensity discharge lamps, such as metal halide lamps. Further ignition pulses can be provided for each discharge, or there can be two and only two per discharge. Accordingly, the drawings and description are to be regarded as illustrative in nature and not in a restrictive or limiting sense with the scope of the application being indicated in the claims.

What is claimed is:

1. An apparatus comprising:

a gas discharge lamp having a cathode, an anode, and an ignition electrode;

a pulse generating system for providing a first electrical pulse and a second electrical pulse to the ignition electrode, the second pulse occurring within a predetermined time after the first pulse; and a power supply for generating one discharge between the cathode and anode per set of first and second electrical pulses.

2. The apparatus of claim 1, wherein the predetermined time is less than 300 microseconds.

3. The apparatus of claim 1, wherein the predetermined time is less than 150 microseconds.

4. The apparatus of claim 1, wherein the predetermined time is less than 125 microseconds.

5. The apparatus of claim 1, wherein the gas discharge lamp is a xenon flash lamp.

6. The apparatus of claim 1, wherein the ignition electrode is one of the cathode or the anode.

7. The apparatus of claim 1, wherein the ignition electrode is located within a bulb of the gas discharge lamp.

8. The apparatus of claim 1, wherein the ignition electrode is distinct from the anode and the cathode.

9. The apparatus of claim 1, the pulse generating system comprising:

a first circuit for providing the first electrical pulse; and a second circuit for providing the second electrical pulse, the second circuit having at least some circuit components not in the first circuit.

10. The apparatus of claim 9, the first circuit comprising a first capacitor and the second circuit comprising a second capacitor.

11. The apparatus of claim 9, the first circuit comprising a first inductor and the second circuit comprising a second inductor.

12. The apparatus of claim 1, the pulse generating system comprising a circuit with shared components for providing both the first electrical pulse and the second electrical pulse.

13. The apparatus of claim 12, the circuit comprising a capacitor, the capacitor being discharged a first time, recharged, and discharged a second time to provide the first and second electrical pulse set.

14. The apparatus of claim 12, the circuit comprising an inductor, the inductor being discharged a first time, recharged, and discharged a second time to provide the first and second electrical pulse set.

15. The apparatus of claim 1, wherein the discharges are provided in a series of at least three discharges regularly spaced at least 1 millisecond apart and two electrical pulses are provided for each discharge.

16. The apparatus of claim 1, wherein the pulse generating system provides two and only two pulses per discharge.

17. The apparatus of claim 1, wherein the gas discharge lamp is a lamp that operates continuously and is not designed to provide a series of flashes.

18. The apparatus of claim 1, wherein the power supply generates a continuous discharge between the cathode and anode, the continuous discharge initiated by the set of first and second electrical pulses.

* * * * *